US005939663A

United States Patent [19]

Walters et al.

[11] Patent Number: 5,939,663

[45] Date of Patent: Aug. 17, 1999

[54] METHOD FOR DISPERSING A JET FROM A SHAPED CHARGE LINER VIA MULTIPLE DETONATORS

[75] Inventors: William Walters, Elkton; Richard Summers, Conowingo, both of Md.

[73] Assignee: The United States of America as represented by the Secretary of the Army, Washington, D.C.

[21] Appl. No.: 08/544,082

[22] Filed: Feb. 14, 1996

[51] Int. Cl.[6] ..... F42B 12/10

[52] U.S. Cl. ..... 102/476; 102/306; 102/491; 102/492

[58] Field of Search ..... 102/305–310, 102/475, 476, 491, 492, 493; 112/701

[56] References Cited

U.S. PATENT DOCUMENTS

| | | | |
|---|---|---|---|
| 3,732,818 | 5/1973 | Thomanek | 102/306 |
| 3,978,796 | 9/1976 | Hackman | 102/476 |
| 4,711,181 | 12/1987 | Ringel et al. | 102/476 |
| 4,784,062 | 11/1988 | Rudolf et al. | 102/476 |
| 4,982,667 | 1/1991 | Weimann | 102/476 |

FOREIGN PATENT DOCUMENTS

| | | | |
|---|---|---|---|
| 2704052 | 10/1994 | France | 102/476 |
| 3728559 | 3/1989 | Germany | 102/476 |
| 2065840 | 7/1981 | United Kingdom | 102/306 |
| 2170888 | 8/1986 | United Kingdom | 102/476 |

*Primary Examiner*—Harold J. Tudor
*Attorney, Agent, or Firm*—Paul S. Clohan, Jr.; U. John Biffoni

[57] ABSTRACT

A method and apparatus are provided for selectively producing a coherent or dispersed jet pattern upon detonation of a shaped charge ammunition round. Multiple detonators are provided which may be arranged in a symmetrical or non-symmetrical pattern around or on the axis of the charge. Selection of a coherent or dispersed jet pattern may be provided by controlling the number and timing of detonators used. A coherent jet may be produced, for example, by actuating only one detonator along the centerline of the round. Dispersed jets in selected patterns may be achieved by actuating multiple detonators in different patterns.

10 Claims, 6 Drawing Sheets

METHOD FOR DISPERSING A JET FROM A SHAPED CHARGE LINER VIA MULTIPLE DETONATORS

CROSS-REFERENCE TO RELATED APPLICATIONS

The subject matter of this application is related to that disclosed in U.S. Pat. Nos. 5, 551, 346 and 5, 569, 873, and application Ser. No. 08/668,606, now U.S. Pat. No. 5,616, 885, filed currently herewith.

The invention described herein may be manufactured, used and/or licensed by or for the United States Government.

FIELD OF THE INVENTION

The present invention relates to a method and apparatus for dispersing a jet from a shaped charge liner in an ammunition round to provide a wider impact area against large targets.

BACKGROUND OF THE INVENTION

Shaped charge designs in present use (i.e., in weapon systems, oil well completion, or drilling operations) may be designed to provide a deep hole in a target material and maximize crater volume. Such shaped charge configurations achieve maximum penetration by projecting a continuous rod or a stream of particles, in near perfect alignment, against a target material. Since penetration is directly proportional to the length of the penetrator, care is taken to maximize the jet length and to keep jet particles well aligned. This concept results in deep holes, of relatively small diameter, in a target.

However, certain applications may require attack of relatively thin targets (i.e., materials of low strength and small thicknesses). Conventional shaped charges do relatively little damage against such targets. For example, a shaped charge fired against a lightly armored vehicle will do minimal ballistic damage. The jet will perforate such a vehicle leaving only a small entrance and exit hole. Against targets of this type, it may be advantageous to reduce the effective depth of penetration and spread the impacting penetrator jet over a wider surface area to maximize the total damage to the target. This type of damage may be obtained by dispersing the jet in a radial fashion to increase the surface area impacted by the jet.

In addition, it may be desirable to provide a particular jet pattern for particular types of targets. For example, when using a shaped charge to destroy a missile or the like, a particular pattern may be desirable to insure that at least a portion of the penetrator jet impacts the missile.

Moreover, it may be desirable to provide a shaped charge round which may be selectively provided with either aligned and dispersed jets. The use of a single round type to provide both types of charges may reduce inventory costs significantly and allow for selection, in the field, of charge type for a given round. In addition, the use of a same or similar charge type for both aligned and dispersed jets may reduce manufacturing costs of such charges due to the economies of scale in manufacturing a common charge design.

FIG. 1 is a cross section view of a prior art shaped charge round. Explosive fill 10 within casing 24 surrounds a hollow cavity made by liner 15. Casing 24 may comprise a metallic (e.g., thin aluminum or steel) or non-metallic (e.g., composite graphite, plastic, cardboard or the like). Alternatively, no casing may be provided for example, for a static charge fired from a stationary position.

Liner 15 is illustrated in FIG. 1 as a conical insert with a thin wall although any arcuate geometry 15', as shown in FIG. 4A, may be used depending on desired result. Casing 24 may be a regular cylinder or may take other forms (e.g., tapered or boat-tailed cylinder). The shaped charge round of FIG. 1 may be typically point initiated by a. booster/detonator assembly 18 located along an axis of revolution of the round.

The shaped charge round of FIG. 1 may be incorporated into an artillery shell, mortar shell, missile (e.g., surface to air missile, wire guided missile, air to air missile, or the like) or may be incorporated into charges used for industrial purposes (e.g., oil exploration, mining, explosive welding, or the like).

Once the round of FIG. 1 has been detonated, liner 15 collapses to form a high speed jet. The use of liner 15 is described, for example, in H. Mohaupt, U.S. Pat. No. 2,419,414, issued Apr. 22, 1947, incorporated herein by reference.

SUMMARY AND OBJECTS OF THE INVENTION

A shaped charge ammunition round is provided for selectively producing a coherent or dispersed jet pattern when detonated. The shaped charge includes a substantially cylindrical outer casing having an open end, an explosive charge within the substantially cylindrical outer casing, a shaped charge liner, contained in the substantially cylindrical outer casing and covering the open end of the substantially cylindrical outer casing, and at least two initiation devices which may be selectively actuated so as to selectively produce a coherent or disrupted jet upon detonation of the shaped charge ammunition round.

The shaped charge ammunition round may further include an actuation time delay, coupled to the at least two initiation devices, for providing a time delay between actuation of each of the at least two initiation devices to enhance interaction of detonation waves produced by-each of the at least two initiation devices upon detonation. The at least two initiation devices may be arranged in an asymmetric pattern. At least one of the at least two initiation devices may be buried inside the explosive charge.

It is an object, therefore, of the present invention, to disperse the jet of a shaped charge round into a dispersed jet.

It is a further object of the present invention to disperse the jet of a shaped charge round into a dispersed jet of a predetermined pattern.

It is a further object of the present invention to provide an inexpensive and readily implemented apparatus for dispersing the jet of a shaped charge round.

It is a further object of the present invention to provide a round design having common elements for a shaped charge having an aligned jet and dispersed jet applications.

Still other objects and advantages of the present invention will become readily apparent to those skilled in this art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTIONS OF THE DRAWINGS

DETAILED DESCRIPTION OF THE INVENTION

Figure 1:
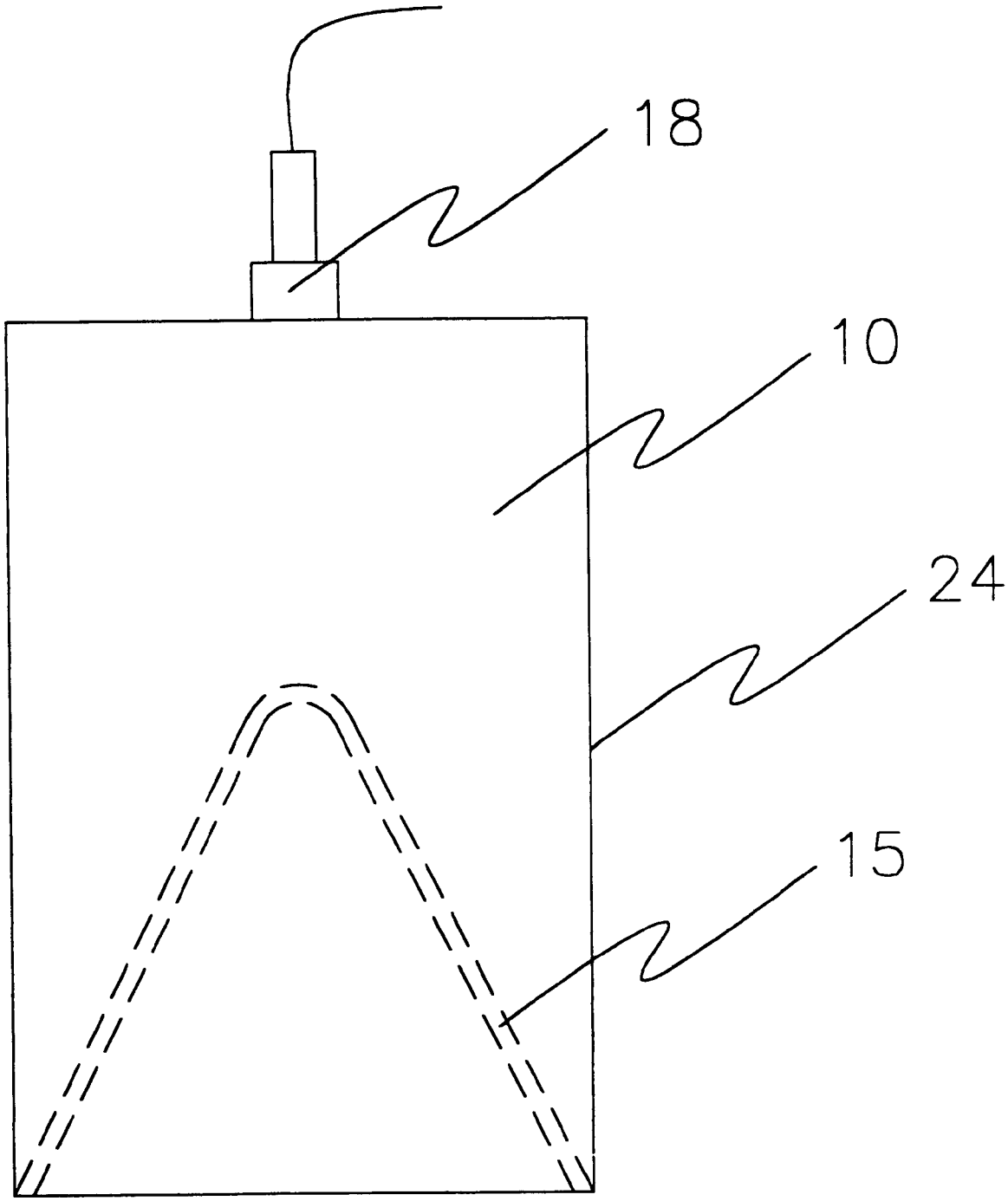
FIG. 1 (PRIOR ART)
FIG. 1 is a side view of a prior art shaped charge illustrating the charge liner in dashed lines.
Figure 2A:
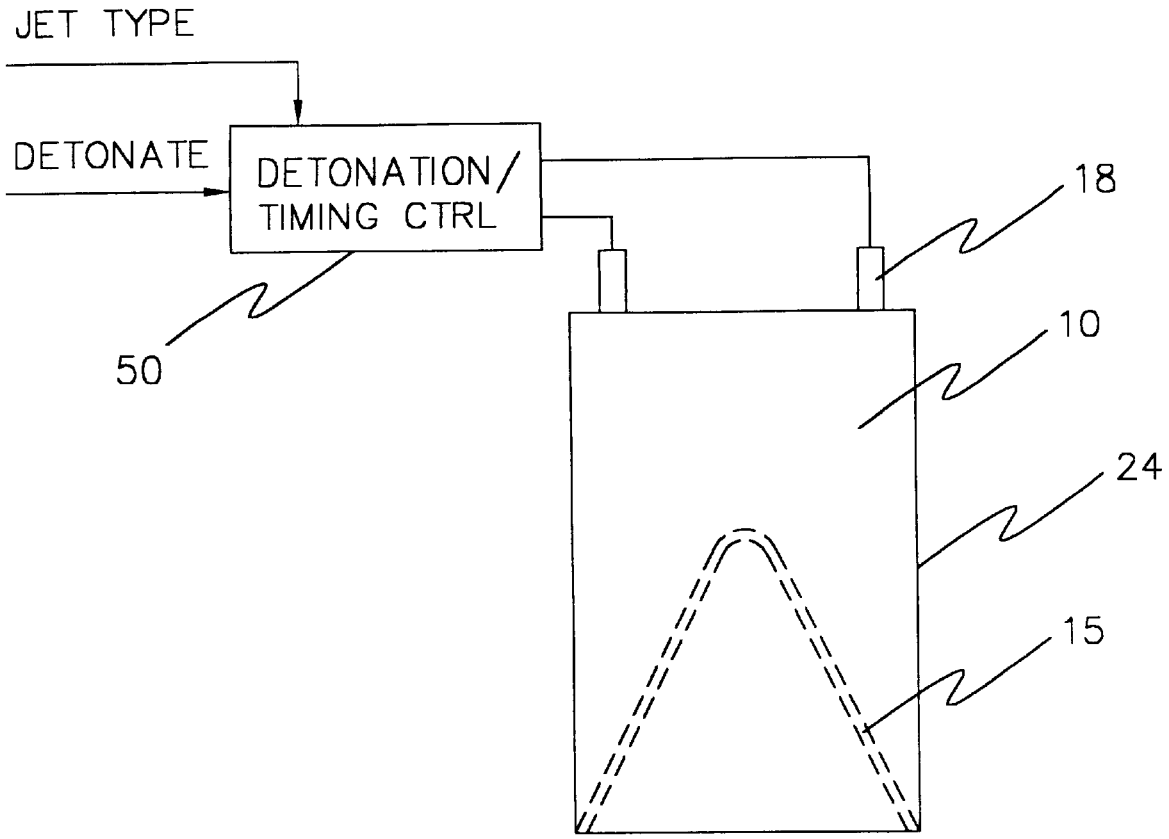
FIG. 2A is a side view of a shaped charge illustrating multiple detonators according to a first embodiment of the present invention.
Figure 2B:
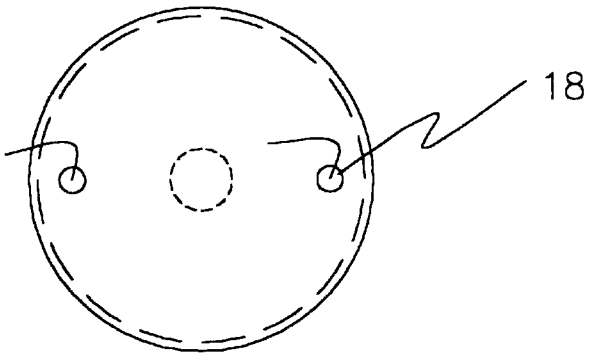
FIG. 2B is a top view of a shaped charge illustrating multiple detonators according to a first embodiment of the present invention.

The apparatus and method of the present invention may disrupt a jet from a shaped charge liner by the use of two or more detonators. Typically, a shaped charge warhead is point initiated or uses one detonator-booster assembly precisely aligned on the charge axis-of-symmetry as shown in FIG. 1. The jet dispersion technique of the present invention involves placing two or more detonator-booster assemblies offset from the center line (axis-of-symmetry) of the charge. In FIGS. 2A and 2B, a two detonator approach is shown with two detonators 18 at a nearly maximum detonator spacing or offset.

Referring to FIGS. 2A and 2B, liner 15 may be caused to disperse by the use of offset detonators 18. In the embodiment of FIGS. 2A and 2B, one approach is to offset detonators 18 to create an interaction of the resulting detonation waves with liner 15 to disperse the resulting jet in a fragmenting type pattern. For the example shown in FIGS. 2A and 2B, the resulting jet may be dispersed at the tip (front) region followed by coherent jet near the tail. Tip dispersion means that the jet splits or bifurcates into a "Y" shape at the tip.

Figure 3A:
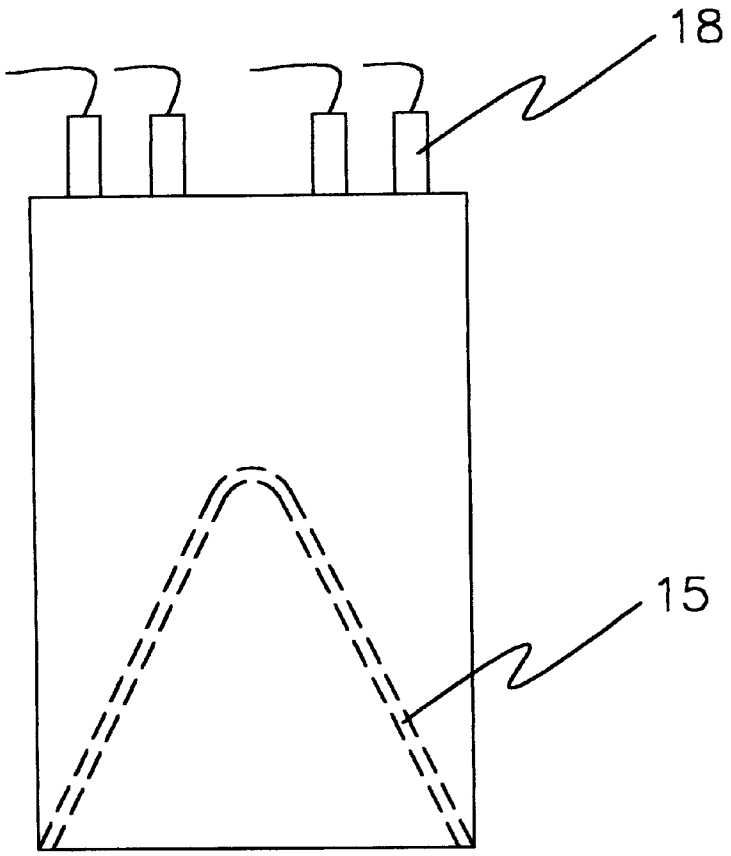
FIG. 3A is a side view of a shaped charge illustrating multiple detonators according to a second embodiment of the present invention.
Figure 3B:
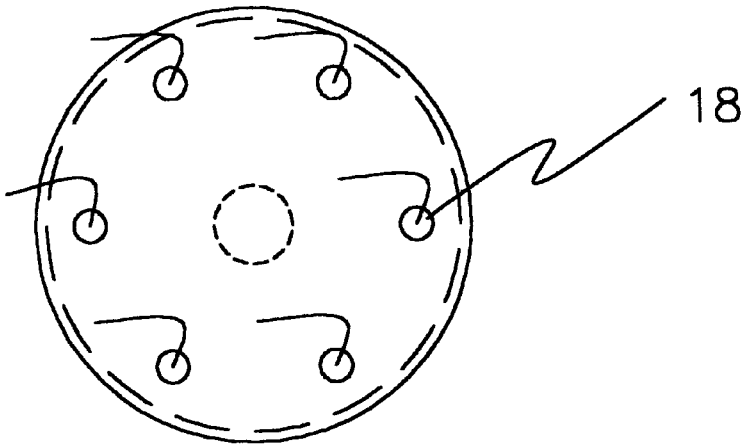
FIG. 3B is a top view of a shaped charge illustrating multiple detonators according to a second embodiment of the present invention.

Dispersion of the tip increases as the distance between the two detonators increases. A test conducted at the Experimental Range Facility Number 16 (test round number 3500) first illustrated this concept. Since the principle of jet disruption is believed to result from the interaction of the detonation waves with each other and with the liner, more than two detonators may be used to disrupt the jet. In fact, any number of detonators may be used as illustrated in FIGS. 3A and 3B, however, sixteen detonators may be a practical upper limit for a six inch diameter charge.

Dispersion or bifurcation of the jet may, in principle, be regulated by the appropriate interaction of detonators 18. Detonators 18 need not be aligned in a uniform fashion and some of multiple detonators 18 may be embedded in high explosive 10 to further enhance the interaction of the detonation waves. In addition, time delays between the detonators may be employed to produce the same effect. Moreover, the physical size of the detonator, as well as its position and depth in the secondary explosive, may produce the same dispersion effect on the resulting jet.

Figure 4A:
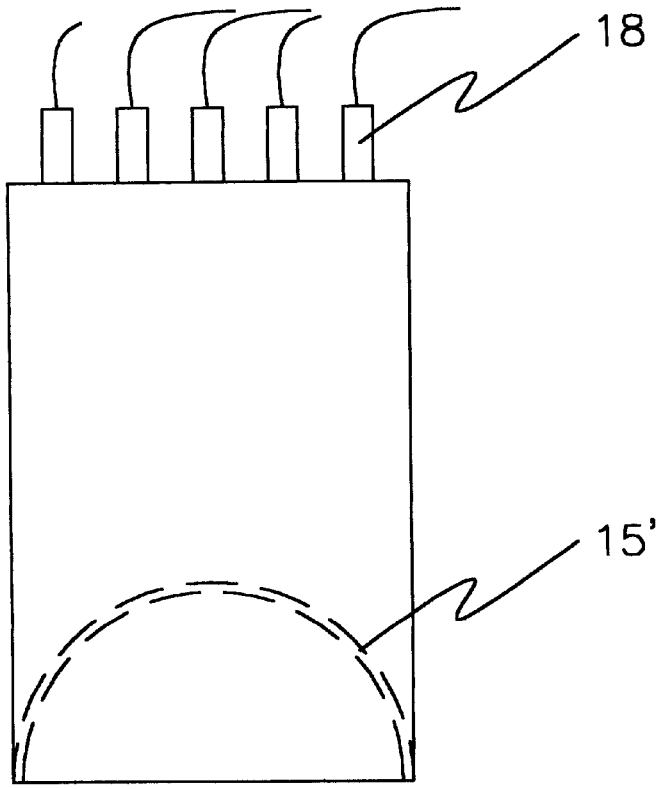
FIG. 4A is a side view of a shaped charge illustrating multiple detonators according to a third embodiment of the present invention.
Figure 4B:
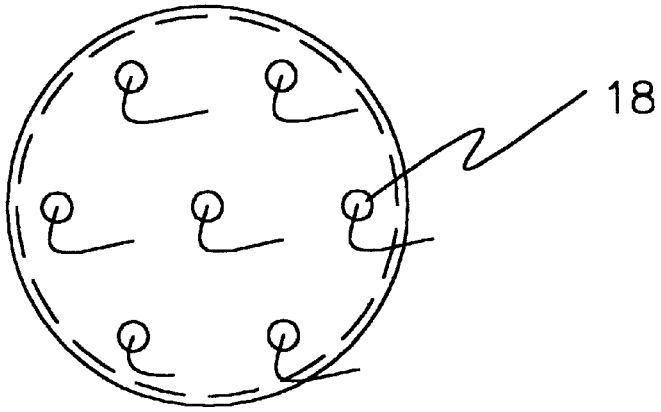
FIG. 4B is a top view of a shaped charge illustrating multiple detonators according to a third embodiment of the present invention.
Figure 5A:
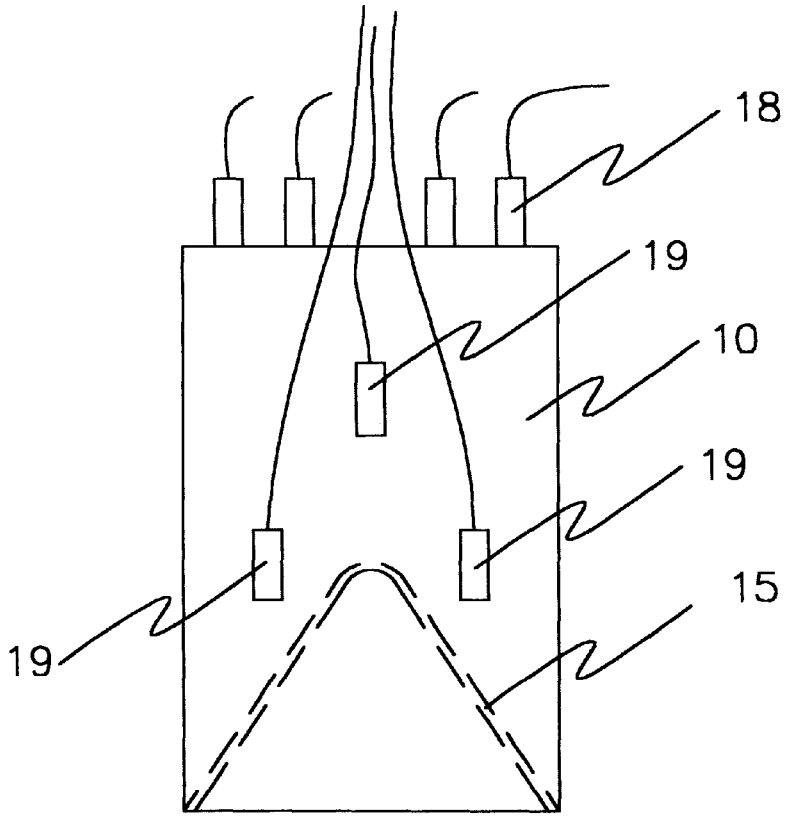
FIG. 5A is a side view of a shaped charge illustrating multiple detonators according to a fourth embodiment of the present invention.
Figure 5B:
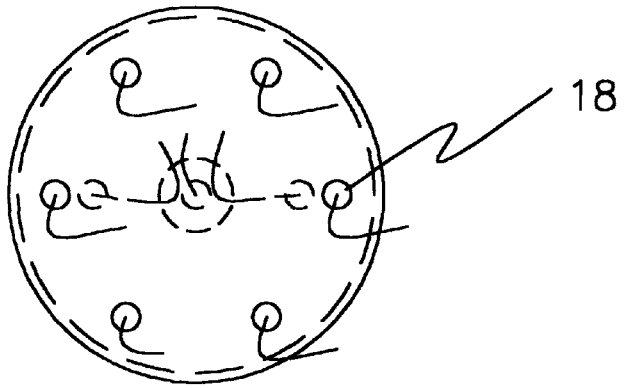
FIG. 5B is a top view of a shaped charge illustrating multiple detonators according to a fourth embodiment of the present invention.
Figure 6A:
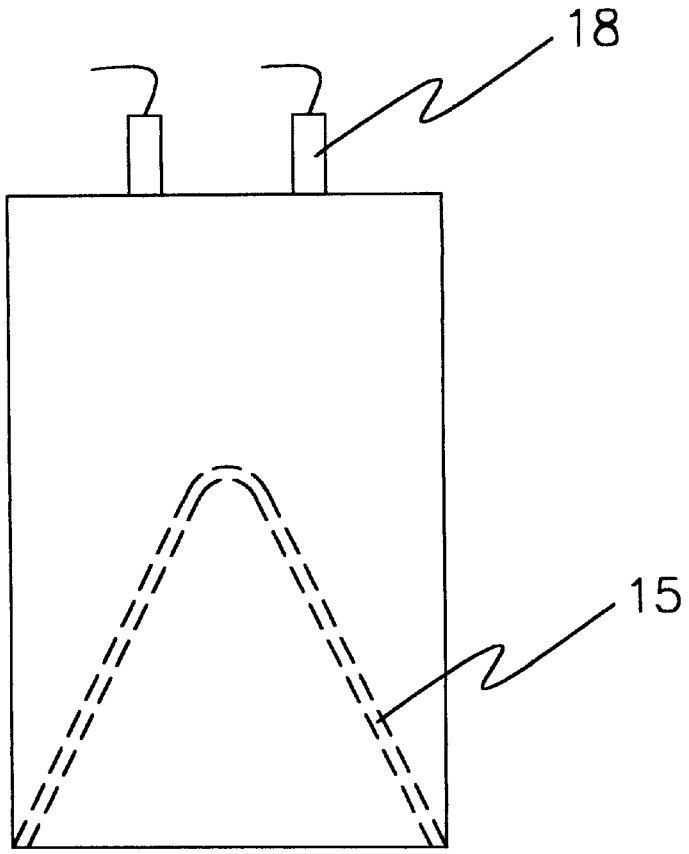
FIG. 6A is a side view of a shaped charge illustrating an asymmetrical arrangement of multiple detonators according to the fifth embodiment of the invention.
Figure 6B:
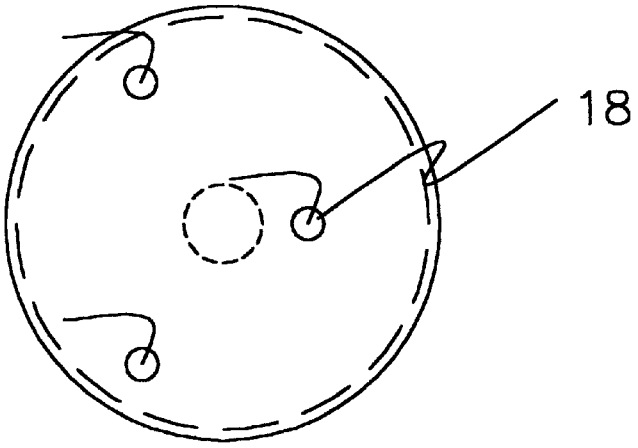
FIG. 6B is a top view of a shaped charge illustrating an asymmetrical arrangement of multiply detonators in accordance with fifth embodiment of the invention.

FIGS. 4A and 4B illustrates an embodiment where detonators 18 are arranged in axial and non-axial positions. An axial detonator 18 may be activated to produce a coherent jet pattern upon detonation. Alternately, non-axial detonators 18 or all detonators (or a selected number of detonators 18) may be selected to produce a dispersed detonation pattern upon detonation. FIGS. 5A and 5B illustrate yet another embodiment where additional detonators 19 may be provided within explosive charge 10 to produce dispersed jet patterns. Again, a combination of detonators (buried or on the surface) may be selectively actuated to produce a particular desired jet pattern.

One advantage of the use of multiple detonators 18 is that additional detonators may be added in the field to an existing shaped charge to alter the resulting jet pattern to match a desired target type. Moreover, when multiple detonators are used, the number and timing of detonators may be selectively enabled or disabled by detonation/timing control 50 as illustrated in FIG. 2A to produced desired dispersed or coherent jet effects. Detonation/timing control 50 is shown in FIG. 2A for the purposes of illustration, however it should be appreciated that detonation/timing control 50 may be selectively applied to the embodiments of FIGS. 3A and 3B, 4A and 4B, 5A and 5B as well. Timing control 50 may comprise an electronic timing control circuit or a pyrotechnic timing control (e.g., detonating fuse or like).

Detonation/timing control 50 may receive a detonation signal as one input and a target or jet type signal as a second input. Detonation/timing control 50 may then detonate selected detonators 18 or detonate selected detonators 18 in a time delayed pattern to produce a desired resulting jet type.

In addition, the number and timing of detonators used may be selectively switched by detonation/timing control 50 using an input from a targeting system prior to detonation. For example, a missile system may detect a target type prior to detonation and select the number of detonators to be activated and the relative timing between those detonators to produce a desired jet effect to match the detected target type.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

While the preferred embodiment and various alternative embodiments of the invention have been disclosed and described in detail herein, it may be apparent to those skilled in the art that various changes in form and detail may be made therein without departing from the spirit and scope thereof.

What is claimed is:

1. A shaped charge ammunition round for selectively producing a coherent or radially dispersed jet pattern when detonated, comprising:

(a) a substantially cylindrical outer casing having an open end and a closed base end;

(b) a shaped charge liner positioned within said outer casing and covering said outer casing open end;

(c) an explosive charge contained within said outer casing between said outer casing base end and said liner;

(d) at least two detonators; wherein at least one of said detonators is completely embedded within said explosive charge and completely separated from said outer casing base end by said explosive charge, and the other detonators are located at said outer casing base end or embedded within said explosive charge, with at least some of said detonators being located at different distances from the base end of said casing, and wherein at least one of said detonators is positioned on the longitudinal axis of said liner; and (e) means for selectively actuating said at least two detonators; wherein a coherent jet is produced when only said axial detonator is actuated, and wherein a radially dispersed jet is produced when all of said detonators are actuated, said radially dispersed jet creating an impact area having an increased surface area over that of a coherent shaped charge jet.

2. The shaped charge ammunition round of claim 1, further including actuation time delay means coupled to said at least two detonators, for providing a time delay between actuation of each of said at least two detonators to enhance non-coherent interaction of detonation waves produced by each of said at least two detonators.

3. The shaped charge ammunition round of claim 1, wherein said at least two detonators are arranged in an asymmetric pattern.

4. The shaped charge ammunition round of claim 1, wherein said liner has an arcuate geometry.

5. The shaped charge ammunition round of claim 1, wherein said liner has a conical geometry.

6. A shaped charge ammunition round for producing a radially dispersed jet pattern when detonated, comprising:

(a) a substantially cylindrical outer casing having an open end and a closed base end;

(b) a shaped charge liner positioned within said outer casing and covering said outer casing open end;

(c) an explosive charge contained within said outer casing between said casing base end and said liner;

(d) at least two detonators; wherein at least one of said detonators is completely embedded within said explosive charge and completely separated from said outer casing base end by said explosive charge, and the other detonators are located at said casing base end or embedded within said explosive charge, and with at least some of said detonators being located at different distances from the base end of said casing; and (e) means for actuating said detonators; wherein a radially dispersed jet is produced when said detonators are actuated, said radially dispersed jet creating an impact area having an increased surface area over that of a coherent shaped charge jet.

7. The shaped charge ammunition round of claim 6, further including actuation time delay means coupled to said at least two detonators, for providing a time delay between actuation of each of said at least two detonators to enhance non-coherent interaction of detonation waves produced by each of said at least two detonators.

8. The shaped charge ammunition round of claim 6, wherein said at least two detonators are arranged in an asymmetric pattern.

9. The shaped charge ammunition round of claim 6, wherein said liner has an arcuate geometry.

10. The shaped charge ammunition round of claim 6, wherein said liner has a conical geometry.

* * * * *